US008001633B2

(12) United States Patent
Swain, Jr.

(10) Patent No.: US 8,001,633 B2
(45) Date of Patent: Aug. 23, 2011

(54) SPICA TABLE

(76) Inventor: Samuel M Swain, Jr., Federal Way, WA (US)

( * ) Notice: Subject to any disclaimer, the term of this patent is extended or adjusted under 35 U.S.C. 154(b) by 208 days.

(21) Appl. No.: 12/343,169

(22) Filed: Dec. 23, 2008

(65) Prior Publication Data

US 2010/0154121 A1 Jun. 24, 2010

(51) Int. Cl.
*A47B 7/00* (2006.01)

(52) U.S. Cl. ..... 5/621; 5/624

(58) Field of Classification Search ..... 5/600, 613, 5/602, 603, 612, 617–624, 507.1, 658, 662, 5/632, 646–650; 606/242; 128/845
See application file for complete search history.

(56) References Cited

U.S. PATENT DOCUMENTS 2,533,494 A * 12/1950 Mitchell, Jr. ..... 248/160
3,766,384 A * 10/1973 Anderson ..... 378/209
4,940,218 A * 7/1990 Akcelrod ..... 5/621

* cited by examiner

*Primary Examiner* — Robert G Santos
*Assistant Examiner* — Nicholas Polito
(74) *Attorney, Agent, or Firm* — Jensen & Puntigam, P.S.

(57) ABSTRACT

A spica table, collapsible for storage, which includes stabilizing legs, a separate adjustable support for the upper body and the buttock, to accommodate patients of differing sizes and individual infinitely adjustable leg and foot supports.

5 Claims, 5 Drawing Sheets

SPICA TABLE

TECHNICAL FIELD

This invention relates to the application of spica casts, as well as other casts, wherein the patient must be supported and the limbs must be appropriately positioned and then held in position during the procedure, and more particularly to a spica table that includes adjustable arm supports, adjustable head support, relatively adjustable torso and buttock support means, as well as foot support means mounted to the base, and including sliding hinge and rotational and telescopic joint means, including double ball and socket joints, allowing the placement and support of the hip, knee and ankle in any desired position.

BACKGROUND OF THE INVENTION

There are various pediatric orthopedic traumas and conditions that warrant the application of the spica cast. These conditions range from post-operative immobilization following reconstructive hip procedures, urologic bladder extrophy procedures, femur fractures, pelvic fractures and various hip soft tissue release-type procedures. These various orthopedic and urologic procedures require prolonged positioning in a spica cast to ensure a favorable outcome, and yet the currently existing designs for the spica table do not support the full body of the patient. Therefore, the support staff are required too physically support the lower extremities and arms during the procedure.

In addition to the challenges of the staff during the application of the cast, the current spica tables are large in size and challenge facilities in terms of storage for easy retrieval for use in the facility.

Prior art inventions known to the inventor do not accommodate infants and toddlers but are made for adult surgical procedures and not spica casts, and includes:

U.S. Pat. No. 3,745,996 granted to Rush, Sr., July 1973, discloses a movable frame having a vertically adjustable table top with cantilevered hip support and a pair of cantilevered retraction pieces.

U.S. Pat. No. 4,342,451 granted to Tague, August 1982, discloses a platform mounted on a vertically adjustable pedestal base and including back and torso support means telescopically received by sockets on the platform when the frame is in a cast chair position. The back and torso members are movable to a second position on the platform to form a torso and head support for a supine patient.

U.S. Pat. No. 4,940,218 granted to Akcelrod, July 1990, discloses an orthopedic operating table, including a stand having mounted thereon a platform for support the trunk of a patient and a pair of appendage supporting arms.

U.S. Pat. No. 5,658,315 granted to Lamb et al, August 1997, discloses a lower limb traction system, including a perineal post and a traction unit for supporting the leg and maintaining traction.

U.S. Pat. No. 6,634,043 granted to Lamb et al, October 2003, discloses a medical table having a head end column and a pair of foot end columns, all of which are automatically and simultaneously extendable and retractable, having mounted thereon body and separate leg supports.

DISCLOSURE OF THE INVENTION

With the above-noted prior art and inadequacies in mind, it is a goal of the present invention to provide a portable, collapsible spica table which provides adequate support for the patient including infants, toddlers and young adolescents during the procedure while also providing stability and adjustability.

It is a further goal to provide a spica table wherein the support elements are separate and individually adjustable to provide the maximum flexibility in the ability to accommodate the various size and age (infant to young adolescent) of the patients, as well as placing the patient's body in a position which allows the most efficient application of the necessary cast.

The inventive table is specifically designed such that it is easily collapsed for storage and transport.

BEST MODE FOR CARRYING OUT THE INVENTION

Figure 1:
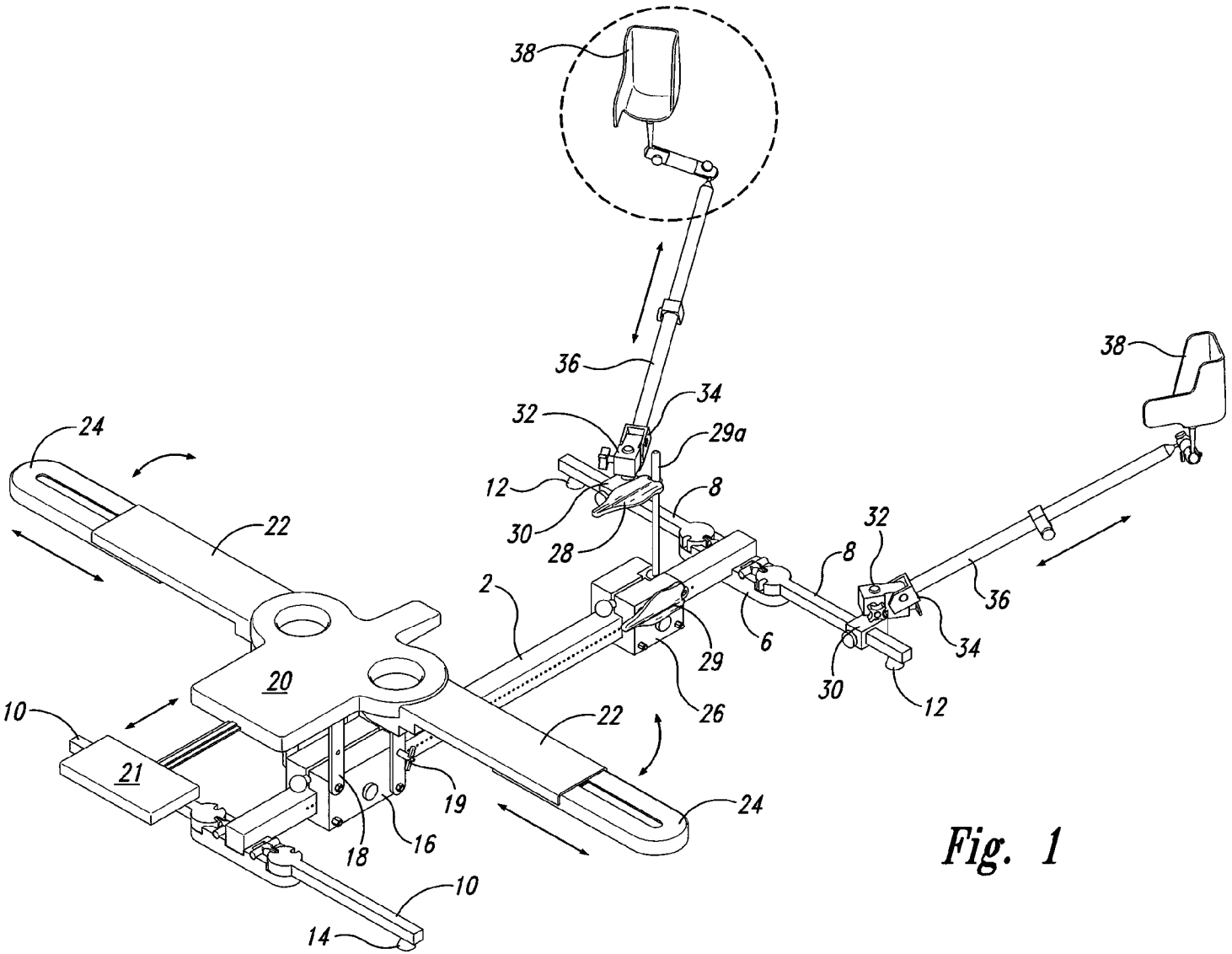
FIG. 1 is a pictorial representation of the inventive spica table.

As seen in FIG. 1, the inventive spica table is structurally built about a central beam 2 which, as will be explained hereinafter, includes horizontal perforations. At each end of beam 2 is a foot 4, 6 to which are attached pivotable outrigger legs 8, 10, each of which includes downwardly extending feet 12, 14 providing a stable platform for the beam 2 and all other mechanisms attached thereto.

At one end of beam 2 there is mounted a sleeve element 16 which is selectively lockable along the beam 2 in any one of the horizontal perforations. Mounted to the sleeve element 16 are two pairs of parallel legs 18 locked in position with T-pin 19, only one of which is shown, which allow the torso support element 20 to be in its extended position as shown, or if desired, collapsed to lay adjacent beam 2 for storage and shipping. Torso support 20 has pivotally mounted thereto a pair of outwardly extending, telescopically mounting arms 22 for supporting the arms of the patient in the position as shown and can be extended, utilizing the extensions 24, or they can be pivoted to lay parallel to the beam 2 for transportation or storage. Torso support 20 also includes adjustable head support 21.

At the opposite end of beam 2 from sleeve 16 is a similar sleeve 26, likewise for incremental movement along the beam, and which supports a pivotally mounted convex buttock support element 28, which likewise can be pivoted downwardly to overlay the beam 2 for storage and shipment. A second buttock support 29 is stored along the side of sleeve 26 for patients of a different size. A perineal post **29*a*** is available for both buttock supports.

Figure 2:
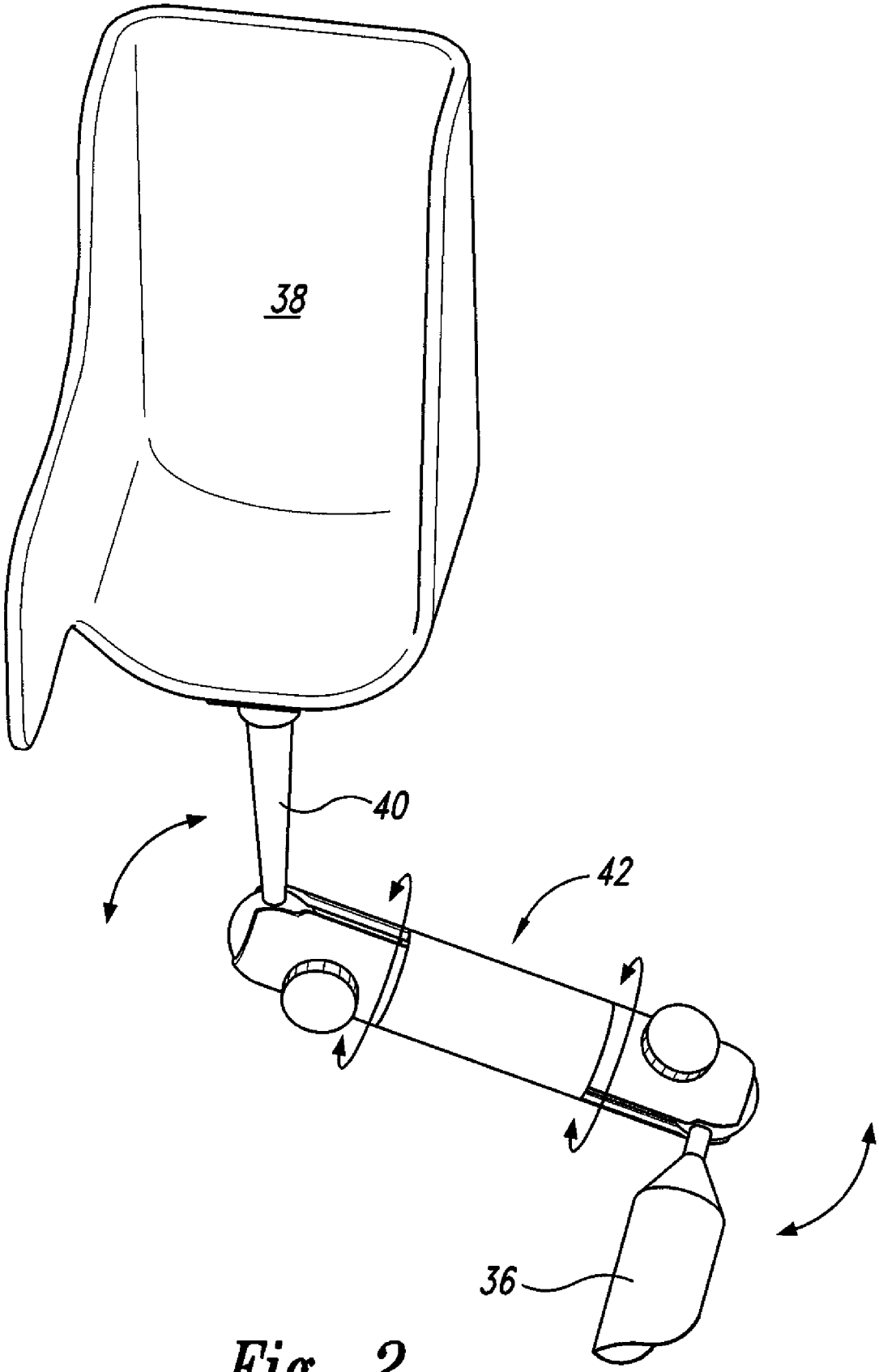
FIG. 2 is an enlarged view of one of the foot supports.

Mounted to the outboard end of legs 8 are supports for the lower extremities which are slidably mounted on the legs 8 by sleeves 30, which have pivotally mounted thereto intermediate supports 32 which are pivotable about a vertical axis and have mounted thereto pivotally and rotatable around a horizontal and transverse axis, U-shaped clamping elements 34 supporting telescopically collapsible arms 36 which have pivotally mounted to the other end thereof foot support 38, more specifically described with respect to FIG. 2.

As seen in FIG. 2, the foot support 38 is contoured such that the patient's foot is cradled and thereby fully supported and stabilized. A lateral strap secures the foot. The foot support 38 is mounted upon a pedestal 40 which is interconnected with the arm 36 by means of double ball and socket joints 42. Thus, it can be seen that between the intersection with the leg 8, telescopic arm 36 and the various joints, 32, 34, 42 permits an infinite choice of position, orientation and stabilization of the individual patient's lower extremities during the procedure.

As will be readily apparent during the procedure, the legs and feet 10 are locked in their outermost position as shown in FIG. 1, the patient's upper body is placed on the upper torso platform 20, with the arms supported by the outwardly extending arms 22, 24 and the buttock of the patient is supported on platform 28 and the legs and feet are respectively manipulated and located in the foot supports 38.

Figure 3:
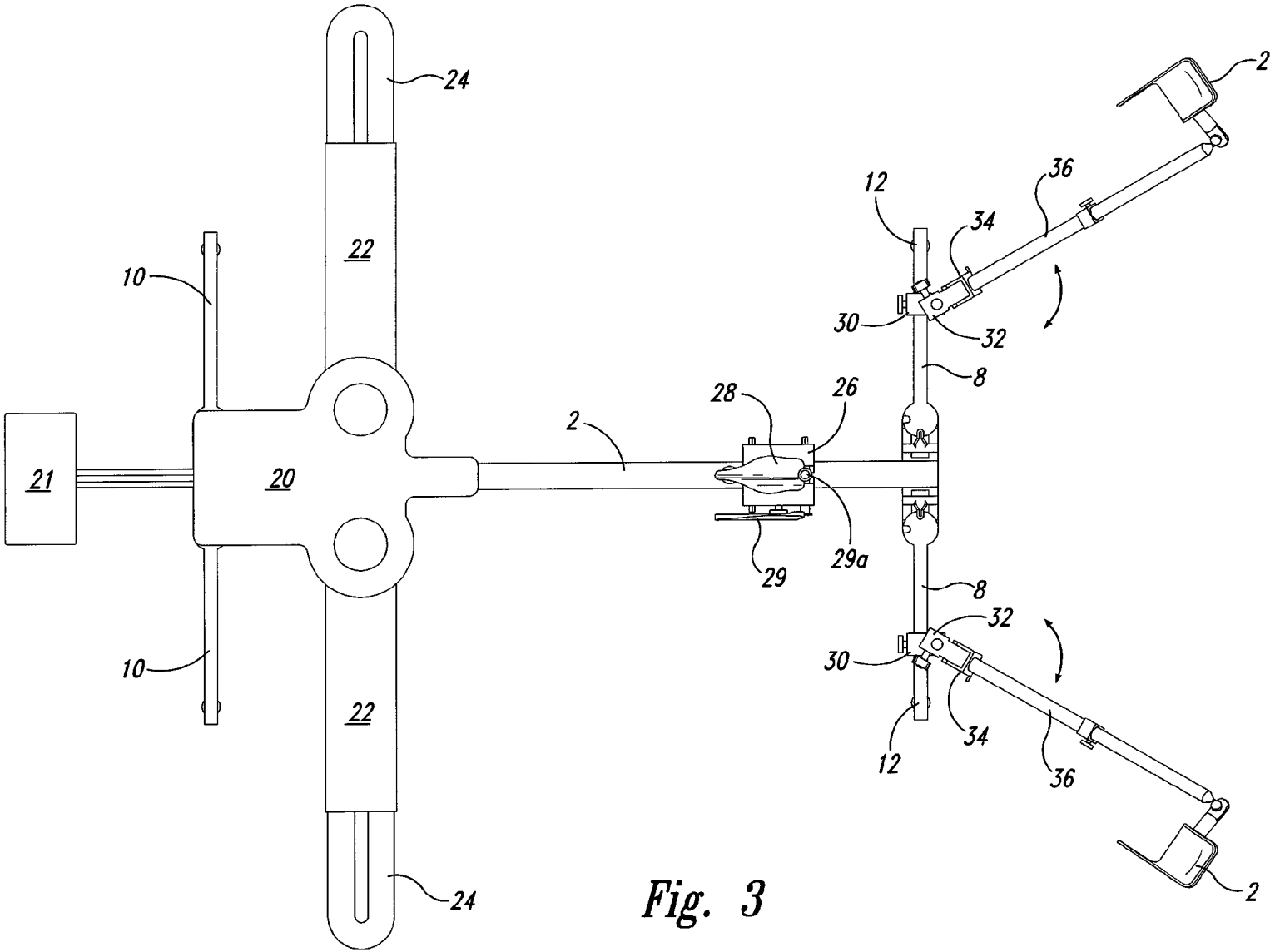
FIG. 3 is a top plan view of the inventive spica table.
Figure 4:
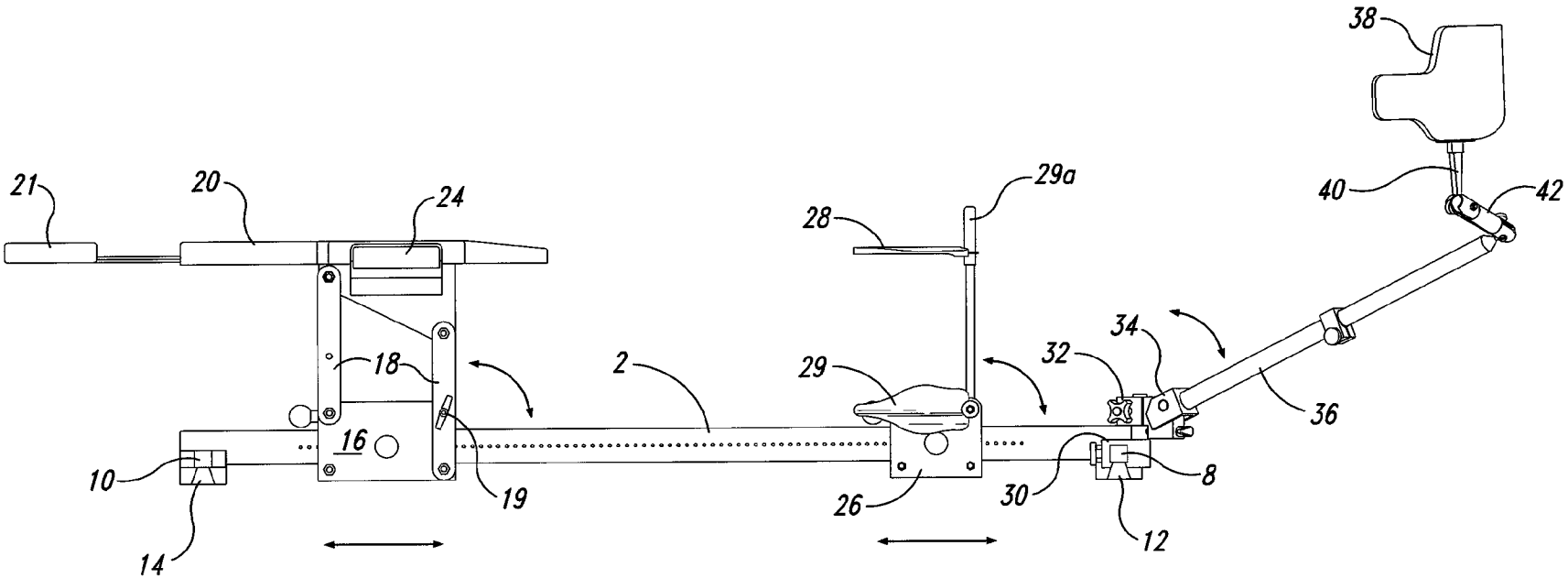
FIG. 4 is an elevational view of the inventive spica table.
Figure 5:
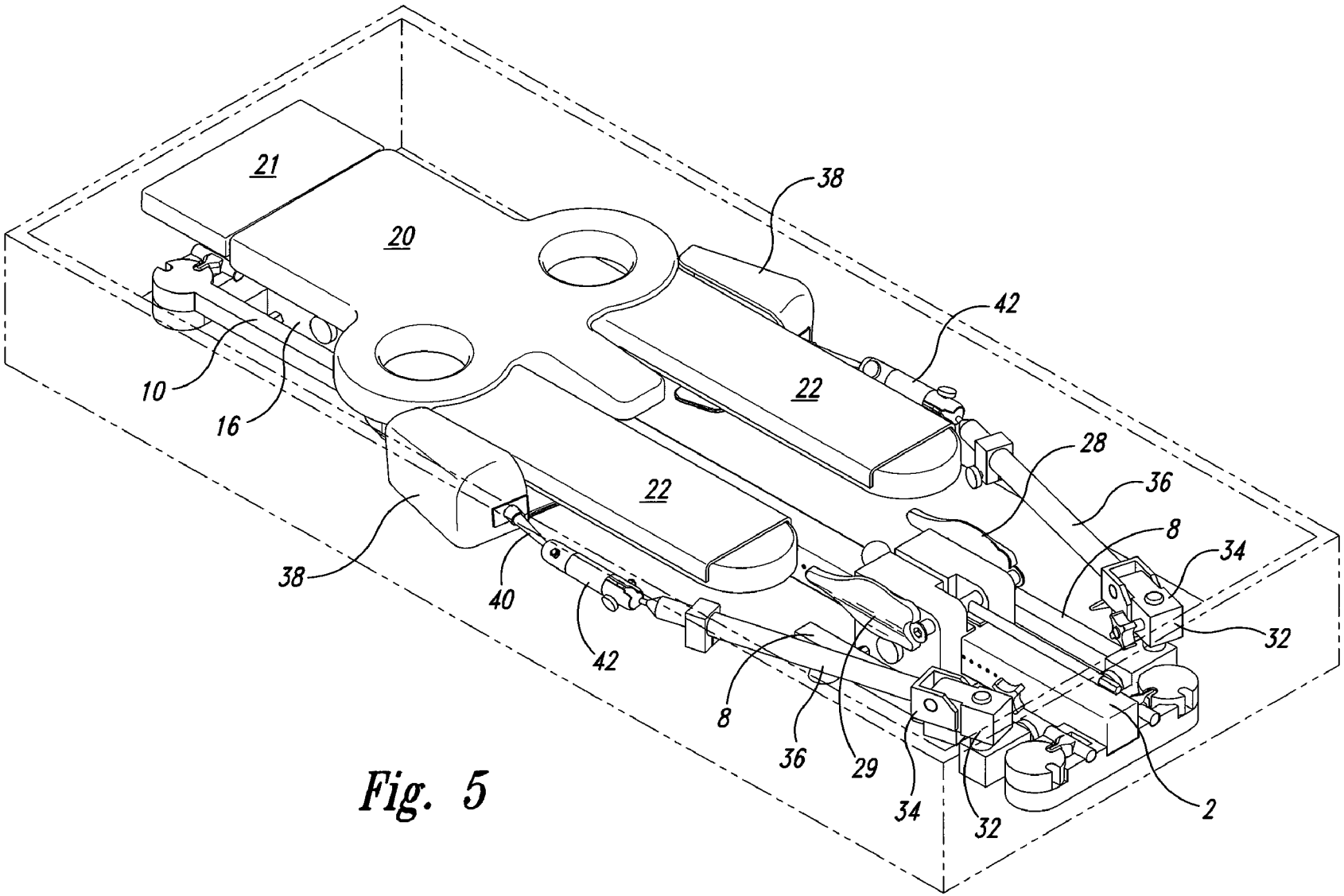
FIG. 5 is a pictorial representation of the spica table in its collapsed and stored configuration.

Reference is now had to FIGS. 3 and 4 which are, respectively, the top plan and side elevational view of the spica table, further enhancing the versatile relationships of the various parts.

FIG. 4 illustrates the versatility of the table, in that all of the parts can be pivoted downwardly and inwardly to form a compact package for storage and/or shipping.

Although a preferred embodiment of the invention has been disclosed herein for the purposes of illustration, it should be understood that various changes, modifications and substitutions may be incorporated in the embodiment without departing from the spirit of the invention, which is defined by the claims which follow.

What is claimed is:

1. A portable spica table, adjustable and capable of being secured in a supportive position for a plurality of body sizes, particularly infants and toddlers, for body casting, comprising:

an elongated horizontal primary beam including pairs of collapsible legs mounted to said beam at opposite ends thereof, said legs extending horizontally perpendicularly outwardly of said beam when in use;

an upper torso support means mounted to said beam for adjustable securement along said beam;

a lower torso support means mounted to said beam for adjustable securement therealong;

a pair of foot support means mounted for adjustable securement along the legs, adjacent to the lower torso support means, on opposite sides of the horizontal beam, said foot support means including an extendable arm adjustable about both a vertical and a horizontal axis at the interconnection with the leg and including a cradle at the opposite end, said cradle adjustably mounted to said arm; and whereby the body and appendages of the patient are fully supported in the appropriate position for casting.

2. A spica table as in claim 1, and further including adjustable arm supports.

3. A spica table as in claim 1, and further including adjustable head support.

4. A spica table as in claim 1, wherein the table is collapsible for transport and storage.

5. A spica table as in claim 1, wherein the foot supports are secured to double ball socket joints for universal adjustment.

* * * * *